US008307800B2

(12) United States Patent
Staley et al.

(10) Patent No.: US 8,307,800 B2
(45) Date of Patent: Nov. 13, 2012

(54) ENGINE HAVING CAMSHAFT LUBRICATION RAIL

(75) Inventors: David R. Staley, Flushing, MI (US); James J. Mazzola, III, Dryden, MI (US); Alan W. Hayman, Romeo, MI (US); Joseph J. Moon, Clawson, MI (US)

(73) Assignee: GM Global Technology Operations LLC

( * ) Notice: Subject to any disclaimer, the term of this patent is extended or adjusted under 35 U.S.C. 154(b) by 414 days.

(21) Appl. No.: 12/720,969

(22) Filed: Mar. 10, 2010

(65) Prior Publication Data

US 2011/0220049 A1 Sep. 15, 2011

(51) Int. Cl.
*F01M 1/06* (2006.01)

(52) U.S. Cl. ..... 123/90.34; 123/90.33; 123/90.6; 123/193.5; 123/196 M

(58) Field of Classification Search ..... 123/90.33, 123/90.34, 90.6, 193.3, 193.5, 196 R, 196 M
See application file for complete search history.

(56) References Cited

U.S. PATENT DOCUMENTS 6,631,701 B2 * 10/2003 Seader et al. ..... 123/90.34

* cited by examiner

*Primary Examiner* — Ching Chang

(74) *Attorney, Agent, or Firm* — Harness, Dickey & Pierce, P.L.C.

(57) ABSTRACT

An engine assembly may include a cylinder head defining a first bearing surface supporting a camshaft, a bearing cap fixed to the cylinder head and a lubrication rail. The first bearing surface may have a first oil inlet extending therethrough. The camshaft may define an axial bore, a first radial passage and a second radial passage. The first radial passage may extend from the axial bore through an outer circumference of the camshaft and may be in communication with the first oil inlet. The second radial passage may extend from the axial bore through an outer circumference of the camshaft. The bearing cap may be fixed to the cylinder head and include a first oil outlet in communication with the second radial passage. The lubrication rail may include a second oil inlet in communication with the first oil outlet and a first lubrication supply passage aligned with a camshaft lobe.

10 Claims, 4 Drawing Sheets

FIG 2
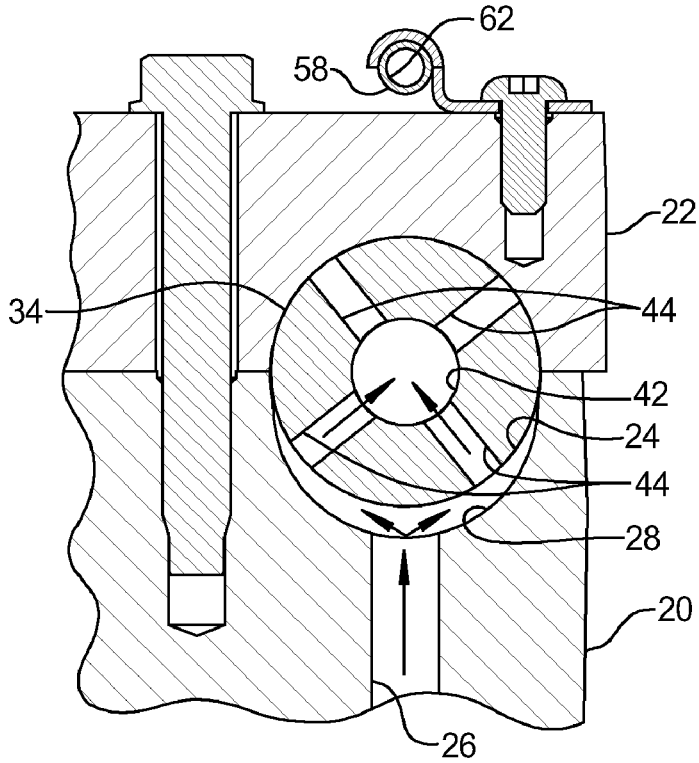
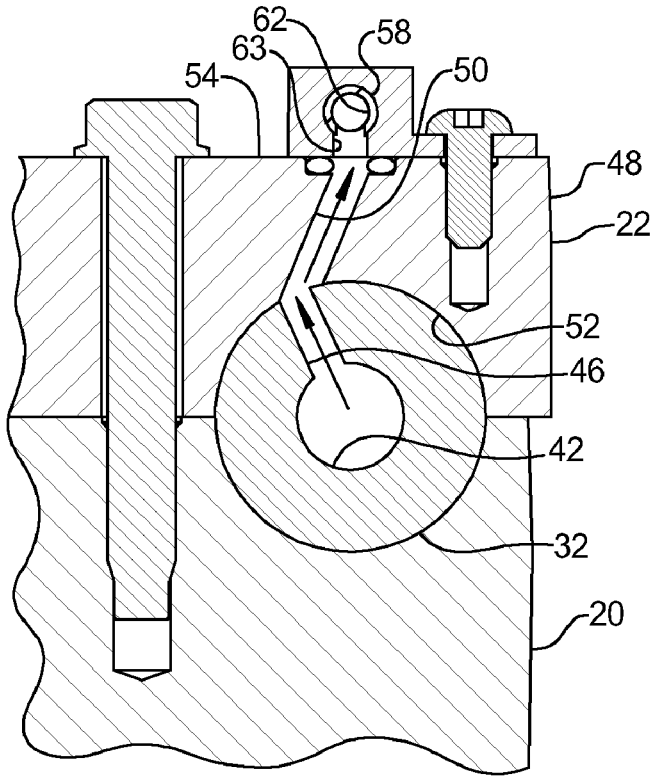
FIG 3

ENGINE HAVING CAMSHAFT LUBRICATION RAIL

FIELD

The present disclosure relates to engine lubrication systems, and more specifically to camshaft lubrication.

BACKGROUND

This section provides background information related to the present disclosure which is not necessarily prior art.

Engine assemblies may lubricate camshaft lobes indirectly through oil leakage at cam bearings. This technique provides minimal control over where oil impacts the lobes and how much oil is provided to the lobes. As a result, the lobes may not be lubricated as desired at extreme operating conditions such as cold low speed operation. Other lobe lubrication methods may directly provide oil flow to the lobes with limited metering of the oil flow resulting in excessive oil flow to the lobes. This excessive oil flow may require additional oil pump capacity to maintain proper oil pressures in the engine, resulting in increased power loss.

SUMMARY

An engine assembly may include a cylinder head defining a first cam bearing surface, a camshaft supported on the first cam bearing surface, a bearing cap fixed to the cylinder head and a lubrication rail. The first cam bearing surface may have a first oil inlet extending therethrough. The camshaft may define an axial bore, a first radial passage and a second radial passage. The first radial passage may extend from the axial bore through an outer circumference of the camshaft and may be in communication with the first oil inlet. The second radial passage may extend from the axial bore through an outer circumference of the camshaft. The bearing cap may be fixed to the cylinder head and may include a first oil outlet in communication with the second radial passage. The lubrication rail may include a second oil inlet in communication with the first oil outlet and a first lubrication supply passage aligned with the camshaft.

In another arrangement an engine assembly may include a cylinder head, a camshaft, a bearing cap and a lubrication rail. The cylinder head may define first and second cam bearing surfaces and a first oil inlet extending through the first cam bearing surface. The camshaft may include first and second lobes, a first journal region and a second journal region. The first journal region may be located between the first and second lobes and may be supported on the first cam bearing surface. The second journal region may be axially spaced from the first journal region and supported on the second cam bearing surface. The camshaft may define an axial bore, a first radial passage and a second radial passage. The first radial passage may extend from the axial bore through an outer circumference of the first journal region and may be in communication with the first oil inlet. The second radial passage may extend from the axial bore through an outer circumference of the second journal region and may have an outlet located between a peak of the first cam lobe and a location ninety degrees rotationally ahead of the peak in a rotational direction of the first cam lobe. The bearing cap may be fixed to the cylinder head and may include a first oil outlet in communication with the second radial passage. The lubrication rail may be fixed to the bearing cap and may include a second oil inlet in communication with the first oil outlet and a first lubrication supply passage axially aligned with the first cam lobe.

A method of lubricating camshaft lobes in an engine assembly may include providing pressurized oil flow to an axial bore within a camshaft and providing communication between a lubrication rail and the axial bore during a first portion of each camshaft revolution. The camshaft may be lubricated by the lubrication rail when the lubrication rail is in communication with the axial bore and the axial bore may be isolated from communication with the lubrication rail during a second portion of each camshaft revolution.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 2 is a first fragmentary section view of the engine assembly of FIG. 1;

FIG. 3 is a second fragmentary section view of the engine assembly of FIG. 1;

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
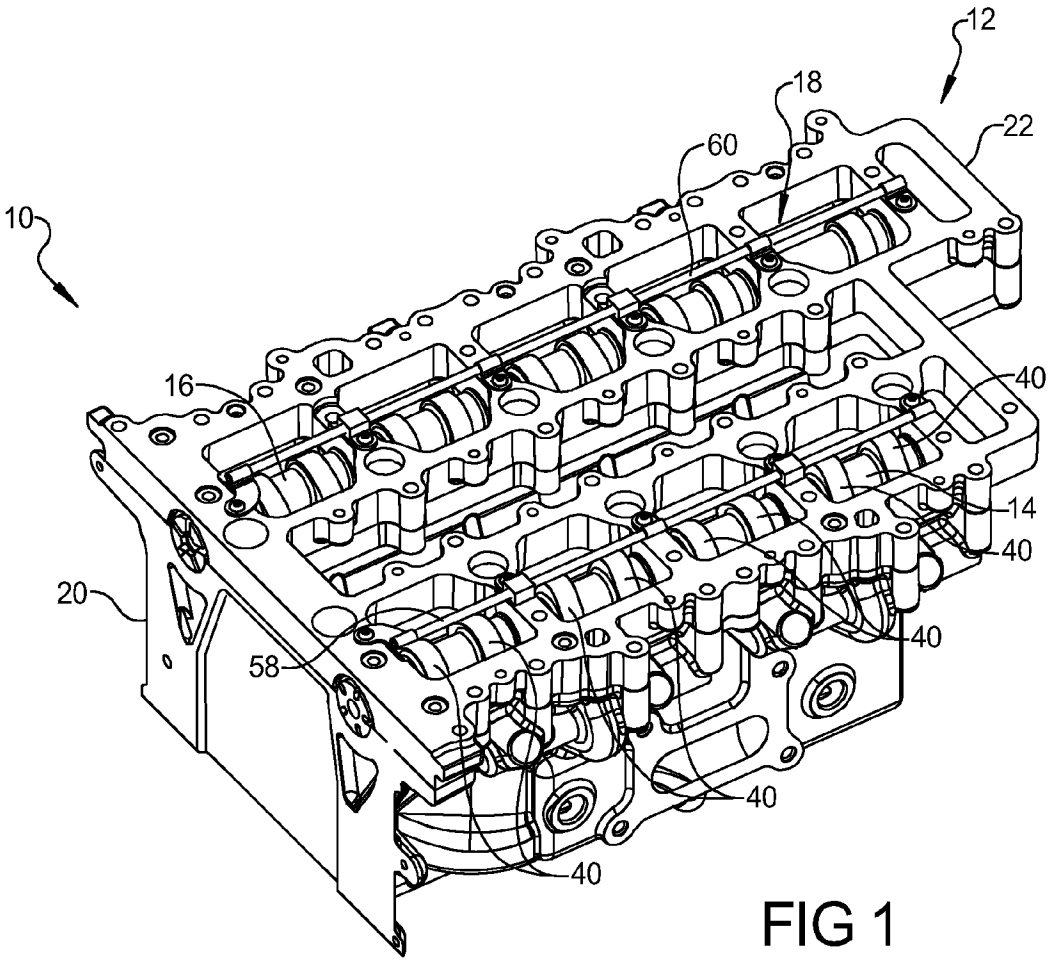
FIG. 1 is a perspective view of a portion of an engine assembly according to the present disclosure.

With reference to FIG. 1, an engine assembly 10 is illustrated. The engine assembly 10 may include an engine structure 12, exhaust and intake camshafts 14, 16 rotationally supported on the engine structure 12, and a lubrication system 18. In the present non-limiting example, the engine assembly 10 is shown as an overhead camshaft engine. However, it is understood that the present disclosure is not limited to overhead camshaft arrangements.

The engine structure 12 may include a cylinder head 20 and a bearing cap 22. While illustrated as a having a single piece bearing cap it is understood that the present disclosure applies equally to arrangements including individual bearing caps for each cam bearing. As seen in FIG. 2, the cylinder head 20 may include a first cam bearing surface 24 and a first oil inlet 26 in communication with a pressurized oil supply and extending through the first cam bearing surface 24. The first cam bearing surface 24 may define an annular oil groove 28 in communication with the first oil inlet 26.

Figure 4:
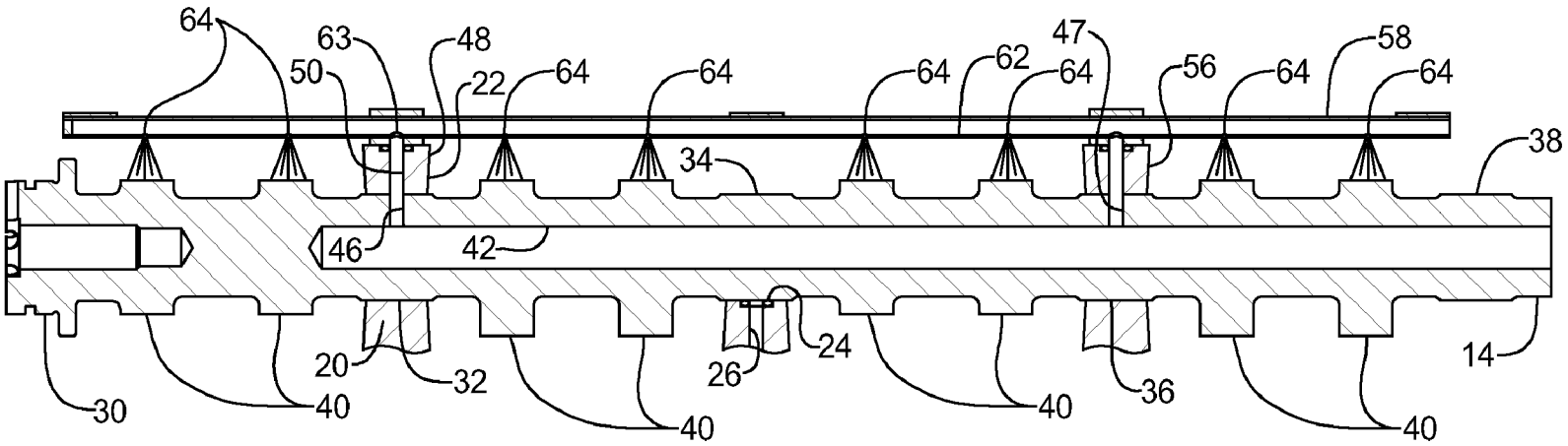
FIG. 4 is a third fragmentary section view of the engine assembly of FIG. 1.

The arrangement of the lubrication system 18 for the exhaust and intake camshafts 14, 16 may be generally similar. Therefore, for simplicity the lubrication system 18 will be described with respect to the exhaust camshaft 14 with the understanding that the description applies equally to the intake camshaft 16. As seen in FIG. 4, the exhaust camshaft 14 may include journal regions 30, 32, 34, 36, 38 between pairs of lobes 40.

With reference to FIGS. 2-4, the camshaft 14 may define an axial bore 42, first radial passages 44 (FIG. 2) and second and third radial passages 46, 47 (FIGS. 3 and 4). The first radial passages 44 may extend from the axial bore 42 and through an outer circumference of the camshaft 14 at the journal region 34. The first radial passages 44 may be circumferentially spaced from one another. In the present non-limiting example, the first radial passages 44 are evenly spaced from one another at ninety degree intervals.

The second radial passage 46 may extend from the axial bore 42 and through an outer circumference of the camshaft 14 at the journal region 32. The journal region 36 may be generally similar to the journal region 32. Therefore, for simplicity, the journal region 36 will not be described in detail with the understanding that the description of the journal region 32 and the first cam bearing surface 24 applies equally to the journal region 36 and corresponding cam bearing surface.

The bearing cap 22 may extend over the journal regions 30, 32, 34, 36, 38 of the camshaft 14. The bearing cap region 48 extending over the journal region 32 may define a first oil outlet 50. The first oil outlet 50 may extend from an inner bearing surface 52 of the bearing cap region 48 to an outer surface 54 thereof. The bearing cap region 56 extending over the journal region 36 may generally similar to the bearing cap region 48.

The lubrication system 18 may include lubrication rails 58, 60 (FIG. 1). The lubrication rails 58, 60 may be generally similar to one another. Therefore, the lubrication rail 58 will be described in detail with the understanding that the description applies equally to the lubrication rail 60. The lubrication rail 58 may be fixed to the bearing cap 22 and may define an interior passage 62, a second oil inlet 63 (FIGS. 2 and 4) and lubrication supply passages 64. The lubrication supply passages 64 may form discharge orifices in the lubrication rail 58. The second oil inlet 63 and the lubrication supply passages 64 may each be in communication with the passage 62.

The second oil inlet 63 may additionally be in communication with the first oil outlet 50 of the bearing cap region 48. The lubrication rail 58 may include an additional oil inlet (not shown) in communication with an oil passage in the bearing cap region 56. The lubrication rail 58 may extend along a length of the camshaft 14. More specifically, the lubrication rail 58 may be located above the camshaft 14 and the lubrication supply passages 64 may be axially aligned with the lobes 40 of the camshaft 14.

During operation, pressurized oil may be provided to the lubrication rail 58 by the oil inlet 26. More specifically, pressurized oil may pass to the groove 28 in the cam bearing surface 24. The oil may travel to the axial bore 42 in the camshaft 14 when the first radial passages 44 are rotationally aligned with the oil groove 28. However, it is understood that the present disclosure is not limited to arrangements including an oil groove and applies equally to arrangements without grooves, where the oil is provided to the axial bore 42 when the first radial passages 44 are aligned with the first oil inlet 26. The pressure of the oil supplied by the first oil inlet 26 may be sufficient to overcome the centrifugal force in the first radial passages 44 resulting from rotation of the camshaft 14.

The oil may travel through the axial bore 42 to the journal regions 32, 36 of the camshaft 14 where the oil is provided to the lubrication rail 58. Specifically, the oil may be provided to the lubrication rail 58 by rotational alignment between the second radial passage 46 and the first oil outlet 50. The centrifugal force in the second radial passage 46 resulting from rotation of the camshaft 14 may force the oil to the lubrication passage 62.

Figure 5:
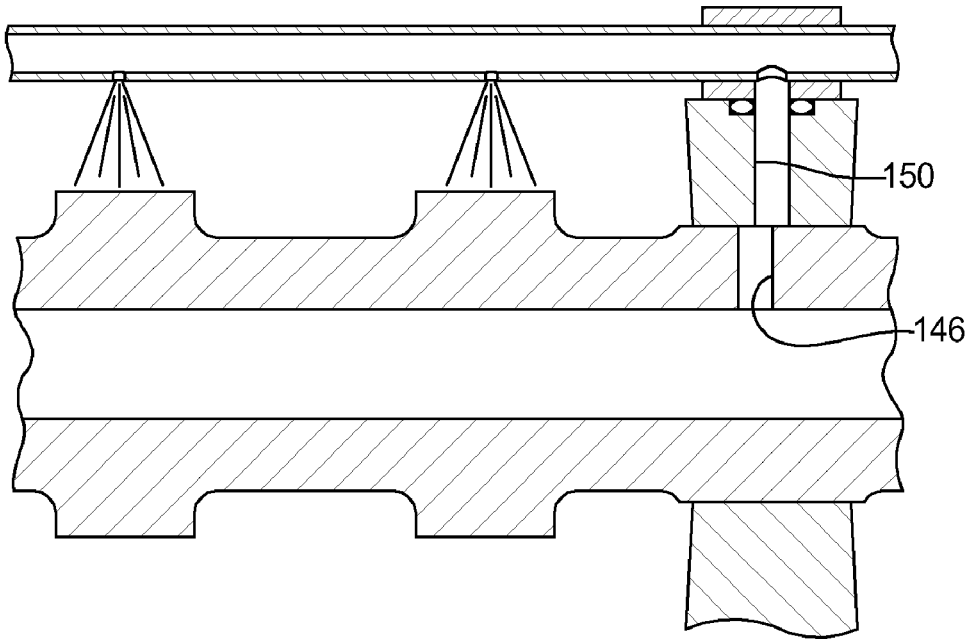
FIG. 5 is a fragmentary section of an alternate engine assembly according to the present disclosure.

The second radial passage 46 may be aligned with the first oil outlet 50 during only a portion of each revolution of the camshaft 14. As a result, engine oil demand can be reduced, requiring a smaller oil pump. In an alternate arrangement, seen in FIG. 5, the centerlines of the second radial passage 146 and the first oil outlet 150 may be offset from one another if further flow restriction is desired.

The rotational positioning of the outlet of the second radial passage 46 may be arranged to provide lubrication to the camshaft lobes 40 when appropriate. By way of non-limiting example, the outlet of the second radial passage 46 of the camshaft 14 may be located circumferentially between a peak of an adjacent one of the camshaft lobes 40 and a position ninety degrees ahead of the peak in a rotational direction of the camshaft 14. The outlet of the second radial passage 46 may be isolated from communication with the lubrication rail during a remainder each camshaft revolution. Locating the outlet of the second radial passage 46 in this manner provides lubrication for the peak of the camshaft lobe 40 before engagement with a corresponding valve lift mechanism (not shown) while limiting overall oil flow, as discussed above.

What is claimed is:

1. An engine assembly comprising:

a cylinder head defining a first cam bearing surface having a first oil inlet extending therethrough;

a camshaft supported on the first cam bearing surface and defining:

an axial bore;

a first radial passage extending from the axial bore through an outer circumference of the camshaft and in communication with the first oil inlet; and a second radial passage extending from the axial bore through an outer circumference of the camshaft;

a bearing cap fixed to the cylinder head and including a first oil outlet in communication with the second radial passage; and a lubrication rail including a second oil inlet in communication with the first oil outlet and a first lubrication supply passage aligned with the camshaft.

2. The engine assembly of claim 1, wherein the camshaft includes first and second cam lobes and a first journal region located between the first and second cam lobes, the first journal region supported on the first cam bearing surface and defining the first radial passage.

3. The engine assembly of claim 2, wherein the first lubrication supply passage is axially aligned with the first cam lobe.

4. The engine assembly of claim 2, wherein the cylinder head defines a second cam bearing surface and the camshaft includes a second journal region axially spaced from the first journal region and supported on the second cam bearing surface and defining the second radial passage.

5. The engine assembly of claim 2, wherein an outlet of the second radial passage is located between a peak of the first cam lobe and a location 90 degrees rotationally ahead of the peak in a rotational direction of the first cam lobe.

6. The engine assembly of claim 1, wherein the camshaft includes a cam lobe defining a peak and an outlet of the second radial passage is located within 90 degrees of the peak.

7. The engine assembly of claim 1, wherein the first cam bearing surface defines an oil groove in communication with the first oil inlet and axially aligned with the first radial passage.

8. The engine assembly of claim 1, wherein a centerline of the first oil outlet is offset from a centerline of the second radial passage providing a flow restriction therebetween.

9. An engine assembly comprising:

a cylinder head defining first and second cam bearing surfaces and a first oil inlet extending through the first cam bearing surface;

a camshaft including first and second cam lobes, a first journal region located between the first and second cam lobes and supported on the first cam bearing surface and a second journal region axially spaced from the first journal region and supported on the second cam bearing surface, the camshaft defining:

an axial bore;

a first radial passage extending from the axial bore through an outer circumference of the first journal region and in communication with the first oil inlet; and a second radial passage extending from the axial bore through an outer circumference of the second journal region and having an outlet located between a peak of the first cam lobe and a location 90 degrees rotationally ahead of the peak in a rotational direction of the first cam lobe;

a bearing cap fixed to the cylinder head and including a first oil outlet in communication with the second radial passage; and a lubrication rail fixed to the bearing cap including a second oil inlet in communication with the first oil outlet and a first lubrication supply passage axially aligned with the first cam lobe.

10. The engine assembly of claim 9, wherein the first bearing surface defines an oil groove in communication with the first oil inlet and axially aligned with the first radial passage.

* * * * *